US009703310B2

(12) United States Patent
Teo

(10) Patent No.: US 9,703,310 B2
(45) Date of Patent: Jul. 11, 2017

(54) BANDGAP VOLTAGE CIRCUIT WITH LOW-BETA BIPOLAR DEVICE

(71) Applicant: Infineon Technologies Austria AG, Villach (AT)

(72) Inventor: Yong Siang Teo, Singapore (SG)

(73) Assignee: Infineon Technologies Austria AG, Villach (AT)

( * ) Notice: Subject to any disclaimer, the term of this patent is extended or adjusted under 35 U.S.C. 154(b) by 0 days.

(21) Appl. No.: 14/288,762

(22) Filed: May 28, 2014

(65) Prior Publication Data

US 2015/0346754 A1 Dec. 3, 2015

(51) Int. Cl.
*G05F 3/02* (2006.01)
*G05F 3/30* (2006.01)

(52) U.S. Cl.
CPC . *G05F 3/02* (2013.01); *G05F 3/30* (2013.01)

(58) Field of Classification Search
CPC ..... G05F 3/00; G05F 3/10; G05F 3/16
USPC ..... 327/539
See application file for complete search history.

(56) References Cited

U.S. PATENT DOCUMENTS

| | | | | |
|---|---|---|---|---|
| 7,233,196 | B2 * | 6/2007 | Farooqui | 327/541 |
| 7,863,882 | B2 * | 1/2011 | Harvey | 323/313 |
| 8,717,090 | B2 * | 5/2014 | Marinca et al. | 327/539 |
| 8,779,734 | B2 * | 7/2014 | Kris et al. | 323/269 |
| 2006/0181336 | A1 * | 8/2006 | Lee et al. | 327/539 |
| 2007/0046363 | A1 * | 3/2007 | Tanzawa | 327/539 |
| 2010/0046580 | A1 | 2/2010 | Hasegawa | |
| 2013/0147446 | A1 | 6/2013 | Kris et al. | |
| 2013/0169250 | A1 * | 7/2013 | Bouwman et al. | 323/272 |
| 2014/0139960 | A1 | 5/2014 | Heo | |

FOREIGN PATENT DOCUMENTS

CN 101655396 A 2/2010

OTHER PUBLICATIONS

Office Action, in the Chinese language, from counterpart Chinese Patent Application No. 201510280755.6, dated Jul. 25, 2016, 9 pp.

* cited by examiner

*Primary Examiner* — Jeffrey Zweizig
(74) *Attorney, Agent, or Firm* — Shumaker & Sieffert, P.A.

(57) ABSTRACT

Representative implementations of devices and techniques provide a reduction in the spread of a bandgap voltage of a bandgap reference circuit. The biasing current for a target bipolar device is conditioned by passing it through one or more like bipolar devices prior to biasing the target bipolar device.

24 Claims, 10 Drawing Sheets

| Parameter | Min (V) | Typical (V) | Max (V) | Spread (V) |
|---|---|---|---|---|
| V8E(Original) | 455.3m | 470.8m | 485.9m | 30.6m |
| V8E(Pass through 1 transistor) | 459.1m | 470.8m | 482.5m | 23.4m |
| V8E(Pass through 2 transistor) | 462.8m | 470.8m | 479.1m | 16.3m |
| V8E(Pass through 3 transistor) | 466.6m | 470.8m | 475.7m | 9.1m |
| V8E(Pass through 4 transistor) | 470.2m | 470.6m | 472.1m | 1.9m |

FIG. 4

| Test | Calculation | Minimum Value | Typical Value | Maximum Value |
|---|---|---|---|---|
| Improved Bandgap Voltage generator | Spread over Temperature | 200.6m | | 663.2m |
| | vref_average | 1.193 | 1.197 | 1.2 |
| | Vref_max over Temperature | 1.195 | | 1.204 (+0.6%) |
| | Vref_min over Temperature | 1.19 (-0.6%) | | 1.197 |
| Original Bandgap Voltage generator | Spread over Temperature | 238.8m | | 770.1m |
| | vref_average | 1.211 | 1.222 | 1.232 |
| | Vref_max over Temperature | 1.213 | | 1.236 (+1.1%) |
| | Vref_min over Temperature | 1.208 (-1.1%) | | 1.227 |

FIG. 7

BANDGAP VOLTAGE CIRCUIT WITH LOW-BETA BIPOLAR DEVICE

BACKGROUND

In today's integrated circuits (IC), the bandgap voltage of a semiconductor device can be used as a voltage reference to drive an internal linear regulator, or similar arrangement to provide predictable power. The bandgap voltage is also often used as a reference voltage for over-temperature detection and for temperature independent current generation. In general, a bandgap voltage may be commonly derived by summing the temperature positive correlated difference in base-emitter voltages of two or more bipolar devices ($\Delta V_{BE}$) with the temperature positive correlated base-emitter voltage of one of the bipolar devices ($V_{BE}$).

The temperature positive correlated $\Delta V_{BE}$ is a factor of thermal voltage. The $\Delta V_{BE}$ can be a constant and independent of process tolerances. As a result, the spread of the bandgap voltage is generally dependent on the performance of the one bipolar device (e.g., transistor, etc.). In today's technologies, such as 0.35 um technologies for example, the focus is more commonly on complementary metal-oxide semiconductor (CMOS) transistors. For example, one or more parasitic PNP transistors may be used to generate the bandgap voltage reference. However, in such cases, the tolerance spread of the bandgap voltage can be larger than desired for some applications.

Currently, trimming techniques at the front end (e.g., laser fusing, etc.) or at the back end (e.g., one time programmable (OTP), PROM, etc.) of a bandgap voltage circuit are often employed to lower the spread of the bandgap voltage. One disadvantage of these techniques is that they can be costly. Additional die area is needed for the trimming circuitry, and an extra step for laser fusing, or the like, at the front end can incur more production cost.

Additionally, it can be difficult to trim the circuit if the bandgap voltage is used for over-temperature protection. It is not common to test such a circuit IC at high temperatures unless the IC is intended to be used for special applications, such as for medical or automotive applications.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure.

FIG. 4 is a table showing a summary of test results, based on the test arrangement of FIG. 3, according to an example.

FIG. 7 is a table showing a summary of test results, based on the circuits of FIGS. 5 and 6, according to an example.

DETAILED DESCRIPTION

Overview

Figure 1:
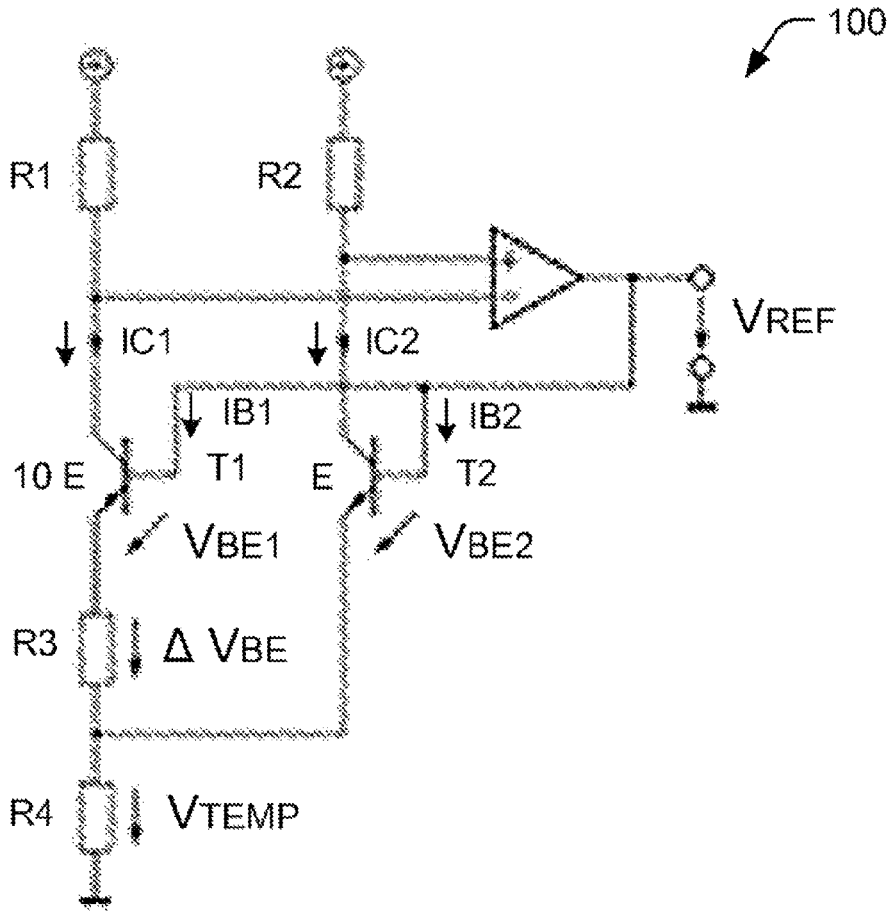
PRIOR ART FIG. 1
FIG. 1 is a schematic diagram of an example bandgap voltage circuit, wherein the techniques and devices disclosed herein may be applied.

Representative implementations of devices and techniques provide a reduced bandgap voltage spread for a bandgap-based reference voltage circuit (including a bandgap-based reference temperature circuit, or the like). Reducing the spread of the bandgap voltage results in a more predictable and precise reference voltage produced by the reference voltage circuit.

Generally, the spread of the bandgap voltage can be attributed to tolerances in bipolar CMOS transistors used to provide the bandgap voltage. The spread of the bandgap voltage may be reduced by reducing the spread of the base-emitter voltage ($V_{BE}$) of a target bipolar transistor, for example. In one implementation, the $V_{BE}$ is reduced by compensating the saturation current of the target transistor using the forward current ratio. For example, the forward current ratio is linearly related to the saturation current.

In one implementation, the biasing current for the target bipolar transistor is "conditioned," by passing the biasing current through a series of other transistors of a similar or a same type. By so doing, the end current product (i.e., the "conditioned current") is a product of the forward current ratio of the transistors. The conditioned current is then used to bias the target bipolar transistor. In the implementation, the use of the conditioned current to bias the target bipolar transistor reduces the spread in the $V_{BE}$ voltage of the target bipolar transistor, and thus reduces the spread of the bandgap voltage.

For the purposes of this disclosure, a bipolar device or a transistor is of a similar or same type as the target device when it uses the same materials, technology, manufacturing type, or construction type, and it is intended to have the same performance specifications as the target device by the manufacturer. For example, a bipolar device of a similar or same type will have the same forward current transfer ratio specification as the target device, and so forth.

In various aspects, the biasing current for the target transistor is conditioned by passing the biasing current through one, two, or more other transistors. In the aspects, the resulting improvement in the bandgap voltage removes a need for trimming at production, thus saving chip area and production costs. In various implementations, the devices and techniques used to reduce the spread of the bandgap voltage are also effective in reducing the spread of the over-temperature protection threshold of an over-temperature protection circuit, improving the quality and safety of the associated applications.

Various implementations and techniques for reducing the spread of the bandgap voltage of a bandgap voltage circuit are discussed in this disclosure. Techniques and devices are discussed with reference to example devices, circuits, and systems illustrated in the figures that use PNP CMOS transistors, or like components. However, this is not intended to be limiting, and is for ease of discussion and illustrative convenience. The use herein of the term "transistor" is intended to apply to all of various bipolar junction-type components. For example, the techniques and devices discussed may be applied to any of various bipolar devices, as well as various circuit designs, structures, systems, and the like, while remaining within the scope of the disclosure.

Implementations are explained in more detail below using a plurality of examples. Although various implementations and examples are discussed here and below, further implementations and examples may be possible by combining the features and elements of individual implementations and examples.

Example Bandgap Voltage Circuit

FIG. 1 is a schematic diagram of an example bandgap voltage circuit 100, an example environment wherein the techniques and devices disclosed herein may be applied. The illustrated circuit 100 comprises one example of a circuit to derive the bandgap voltage, referred to as the Brokaw bandgap reference circuit. In various examples, the disclosed devices and techniques may be equally applied to other circuits providing a reference voltage, a reference temperature, an over-temperature protection, or the like.

As shown in the bandgap voltage circuit 100 of FIG. 1, resistors R1 and R2 determine the collector currents (IC1 and IC2) of bipolar devices T1 and T2, respectively. The difference ($\Delta V_{BE}$) between the base-emitter voltage of bipolar device T1 ($V_{BE1}$) and the base-emitter voltage of bipolar device T2 ($V_{BE2}$) is seen across resistor R3. The output $V_{TEMP}$ is a voltage value derived by summing the temperature positive correlated $\Delta V_{BE}$ with the temperature positive correlated $V_{BE2}$, for example, and is seen across resistor R4.

For the purposes of this example and others discussed herein, T2 can be considered the "target" bipolar device (e.g., PNP transistor) for applying bandgap spread reducing techniques. The target bipolar device or target transistor comprises the device that provides the $V_{BE}$ used for determining the bandgap voltage of the circuit.

In the circuit 100 of FIG. 1, for example, the $V_{BE}$ voltage ($V_{BE2}$, for example) is given by equation 1.

$$VBE = V_T \ln \frac{IC}{IS} \qquad \text{Equation 1}$$

where IC is the collector current, and IS is the saturation current used to describe the transfer characteristics of the transistor of interest in the forward active region. The saturation current IS is given by equation 2.

$$IS = \frac{qAD_n n_{po}}{W_B} = \frac{qAD_n n_i^2}{W_B N_A} \qquad \text{Equation 2}$$

where:

q is the charge,

A is the cross sectional area of the emitter, $D_n$ is the diffusion constant for electrons, $W_B$ is the width of the base from the base emitter depletion layer edge to the base collector depletion layer edge, $N_A$ is the acceptor concentration at the p side, $n_i$ is the intrinsic carrier concentration in the semiconductor material, and $n_{PO}$ is the equilibrium concentration of electrons in the base.

From equation 1, it can be observed that when there is a change in the saturation current IS, the $V_{BE}$ of the PNP transistor will shift accordingly, resulting in a spread of the bandgap voltage. Hence, it may be desirable to compensate for the changes of IS.

Example Implementations

In various implementations, the spread (e.g., range of variance, etc.) of the bandgap voltage is reduced by reducing the spread of the $V_{BE}$ voltage of a bipolar device (the "target" device) within the bandgap voltage circuit. In an implementation, this is achieved by compensating for the saturation current IS using the forward current ratio $h_{FE}$=IC/IB. The forward current ratio IC/IB is linearly related to the saturation current IS.

In an example, the spread of the saturation current IS is compensated for by making use of the forward current gain $\beta_F$. The forward current gain is given by equation 3.

$$\beta_F = \frac{\frac{qAD_n n_{po}}{W_B}}{\frac{1}{2}\frac{n_{po} W_B qA}{\tau_b} + \frac{qAD_p n_i^2}{L_P N_D}} = \frac{2\tau_b L_P N_D D_n}{W_B(W_B L_P N_D + 2\tau_b D_p N_A)} \qquad \text{Equation 3}$$

Equations 2 and 3 show that there are some similarities between $\beta_F$ and IS. For example, they are directly related to the diffusion constant $D_n$ and inversely related to the width of the base $W_B$ from the base-emitter depletion layer edge to the base-collector depletion layer edge and $N_A$. Accordingly, when the forward current ratio IC/IB increases, the saturation current IS is likely to increase. When the bias current IB increases for the target bipolar transistor (T2 in this case), the $V_{BE2}$ voltage percentage increase is likely to reduce. Hence, in an implementation, to compensate the saturation current IS, the target bipolar transistor (e.g., T2) is biased with a current $I_{BIAS}$ proportional to the forward current ratio IC2/IB2.

Figure 2:
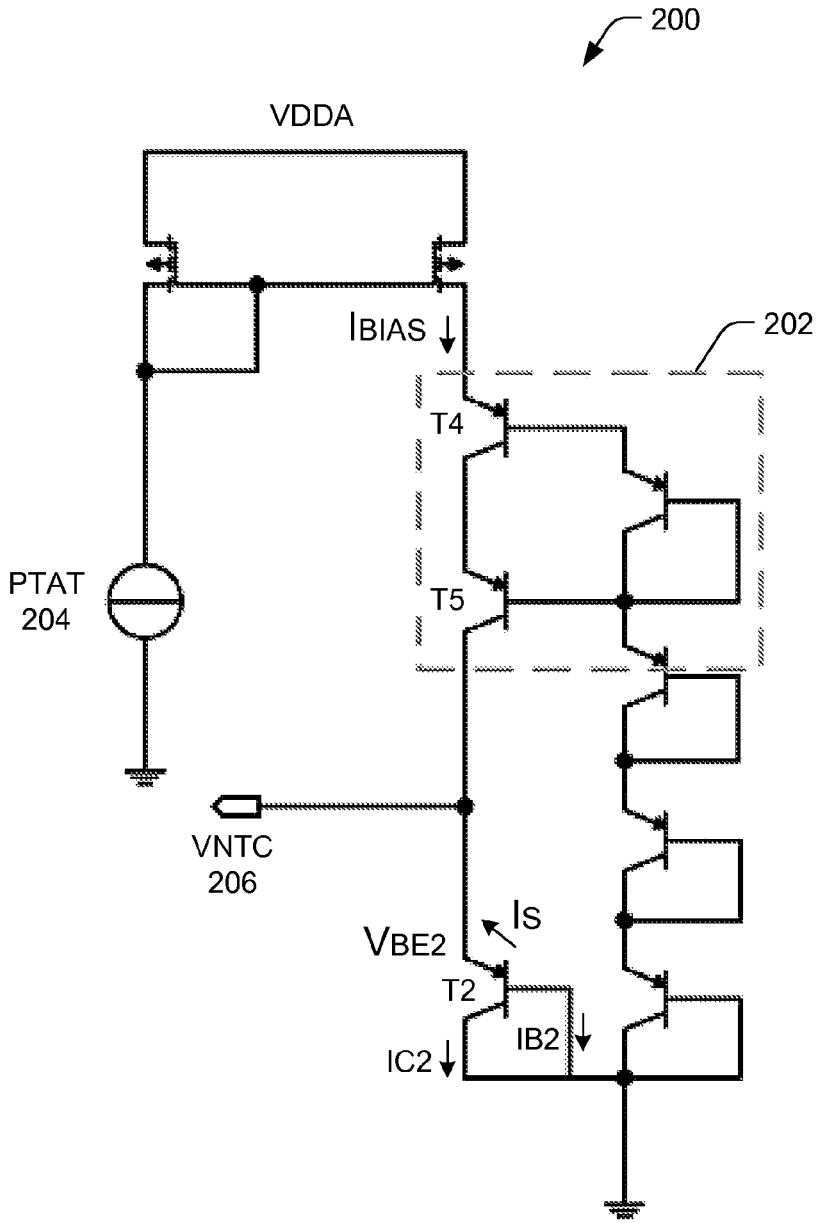
FIG. 2 is a schematic diagram of another example bandgap voltage circuit, with a reduced bandgap voltage spread, according to an implementation.

FIG. 2 is a schematic diagram of an example bandgap voltage circuit 200, with a reduced bandgap voltage spread, according to an implementation. In the example circuit 200 of FIG. 2, the saturation current IS is compensated for, using the forward current ratio IC2/IB2 relationship, via a biasing current $I_{BIAS}$. For example, the biasing current $I_{BIAS}$ for the target transistor (e.g., T2) is passed through a series of transistors (e.g., T4 and T5) of a similar type as the target transistor, "conditioning" the biasing current $I_{BIAS}$. In the example, the conditioned current will be a factor of the forward current ratio. This conditioned current is then used to bias the target bipolar transistor (e.g., T2). This reduces the spread in the $V_{BE2}$ voltage, thus reducing the spread of the bandgap voltage.

In an implementation, as shown in FIG. 2, the biasing current $I_{BIAS}$ is "conditioned," meaning it is passed through a series of bipolar transistors (in this case, T4 and T5) prior to biasing the target transistor (e.g., T2). In the implementation, the devices used to condition the biasing current $I_{BIAS}$, such as devices T4 and T5, are the same or similar type bipolar transistors as T2, the target device. In various implementations, the quantity of transistors (T4, T5) that the biasing current $I_{BIAS}$ is passed through is dependent on the relationship between the forward current ratio IC2/IB2 and the saturation current IS. For example, more transistors (T4, T5) might be desired if the spread (e.g., variance) in the forward current ratio IC2/IB2 is less than the spread (e.g., variance) in the saturation current IS.

In various implementations, the quantity of transistors used to pass the biasing current IS through affects the degree of spread of the $V_{BE}$ voltage of the target device. In an example implementation, the greater the quantity of transistors used, the less spread to the $V_{BE}$ of the target device, and the less spread to the bandgap voltage based on the $V_{BE}$ of the target device.

Referring to FIG. 2, in an implementation, the arrangement 202 includes components, such as devices T4 and T5, that are arranged to condition the biasing current $I_{BIAS}$, to reduce the spread of the bandgap voltage, as described herein. In various implementations, the arrangement 202 includes fewer, additional, or alternative components as described and illustrated in FIG. 2.

The example bandgap voltage circuit 200 of FIG. 2 also includes a PTAT generator 204, arranged to provide a current "proportional to absolute temperature," and a negative temperature coefficient voltage reference 206. The PTAT 204 in the circuit 200 performs similar functions to T1 and associated resistors R3 and R4 in the circuit 100 of FIG. 1, for example. The illustrated design of circuit 200 is for discussion purposes, and is not intended to be limiting. In alternate implementations the circuit 200 may include fewer, additional, or alternative components, and remain within the scope of the disclosure. For example, a bandgap voltage circuit or a reference temperature circuit of differing design and/or components may also be a circuit 200, within the scope of the disclosure.

Figure 3:
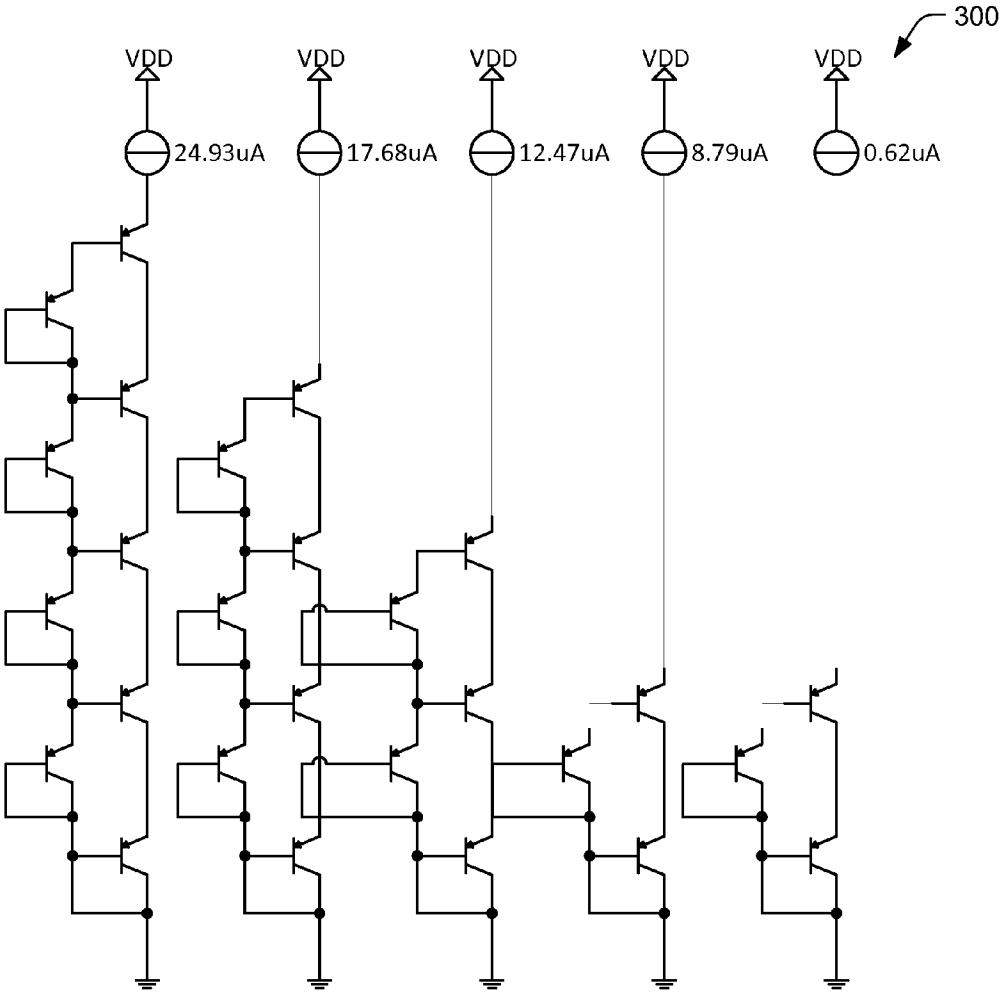
FIG. 3 is a schematic diagram of an example bandgap voltage test arrangement, having multiple channels and different quantities of transistors per channel, according to an implementation.

To further illustrate the technique of conditioning the biasing current $I_{BIAS}$, the biasing current $I_{BIAS}$ may be passed through various quantities of series transistors to measure the effects. For example, the relationship between the spread in $V_{BE}$ and the quantity of transistors used to condition the biasing current $I_{BIAS}$ may be simulated by a test circuit 300, as illustrated in FIG. 3. The relationship is illustrated by passing the biasing current $I_{BIAS}$ through each of various channels of the test circuit 300, where each of the channels has a quantity of series connected transistors, ranging (in the example of FIG. 3) from 1 to 4 transistors in each channel.

In the example, a summary of simulation results of the test circuit 300 is shown in the table of FIG. 4. As shown in FIG. 4, the target device has a $V_{BE}$ spread of 30.6 mV without conditioning the biasing current IS. When the biasing current IS is passed through one transistor, the $V_{BE}$ spread drops to 23.4 mV. Further, as shown, when more transistors are used to condition the biasing current IS, the $V_{BE}$ spread is reduced accordingly. The $V_{BE}$ spread while passing the biasing current IS through 4 transistors, for example, is 1.9 mV, a significant reduction. Thus, the simulation circuit 300 illustrated with FIGS. 3 and 4 demonstrates the extent that the quantity of transistors used to pass the biasing current IS through affects the degree of spread of the $V_{BE}$ voltage of the target device (e.g., T2).

Referring to FIG. 2, in an implementation, by passing the biasing current $I_{BIAS}$ through a transistor (T4, for example), the collector current IC of T4 becomes proportional to the forward current gain IC/IE of T4. The relationship of the emitter current IE to the collector current IC is given by equation 4.

$$I_C = \frac{\beta}{1+\beta} I_E \qquad \text{Equation 4}$$

At the end of the series chain of transistors (e.g., T4, T5) of arrangement 202, the target transistor (e.g., T2) is biased with a collector current IC2 given by Equation 5.

$$I_{C2} = \left[\frac{\beta}{1+\beta}\right]^X I_{BIAS} \qquad \text{Equation 5}$$

where, $I_{BIAS}$ is the original biasing current and X is the quantity of transistors (such as T4 and T5, for example) that $I_{BIAS}$ is passed through.

In an implementation, when the forward current ratio IC/IB increases, the saturation current IS will increase as well. In this situation, if the bias current for T2 does not change, the base-emitter voltage $V_{BE2}$ of T2 will be lower as indicated by equation 1. In the implementation, the biasing current supplying T2 will be higher than in the nominal case. It follows that when the saturation current IS increases, the collector current IC2 is also more than the nominal case. As a result, the base emitter voltage $V_{BE2}$ does not reduce as much (e.g., showing a reduction in the spread of $V_{BE2}$).

In the implementation, the reduction of the spread of $V_{BE2}$ results in a reduction of the spread of the bandgap voltage, which is an output of the summation of $V_{BE2}$ and $\Delta V_{BE}$. The temperature positive correlated $\Delta V_{BE}$ is a factor of thermal voltage, and is a constant and independent of process tolerance.

Example Implementations

Figure 5:
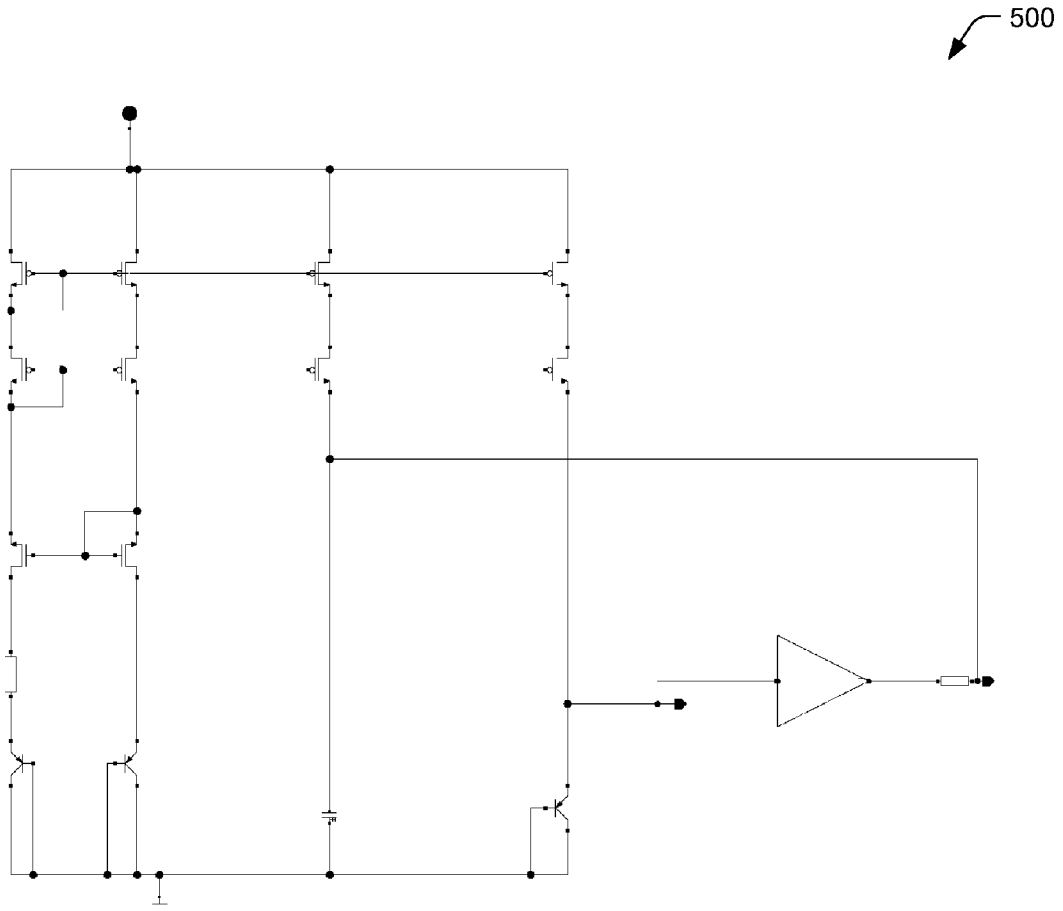
FIG. 5 is a schematic diagram of a bandgap voltage reference circuit, without reduced voltage spread techniques applied, according to an example.
Figure 6:
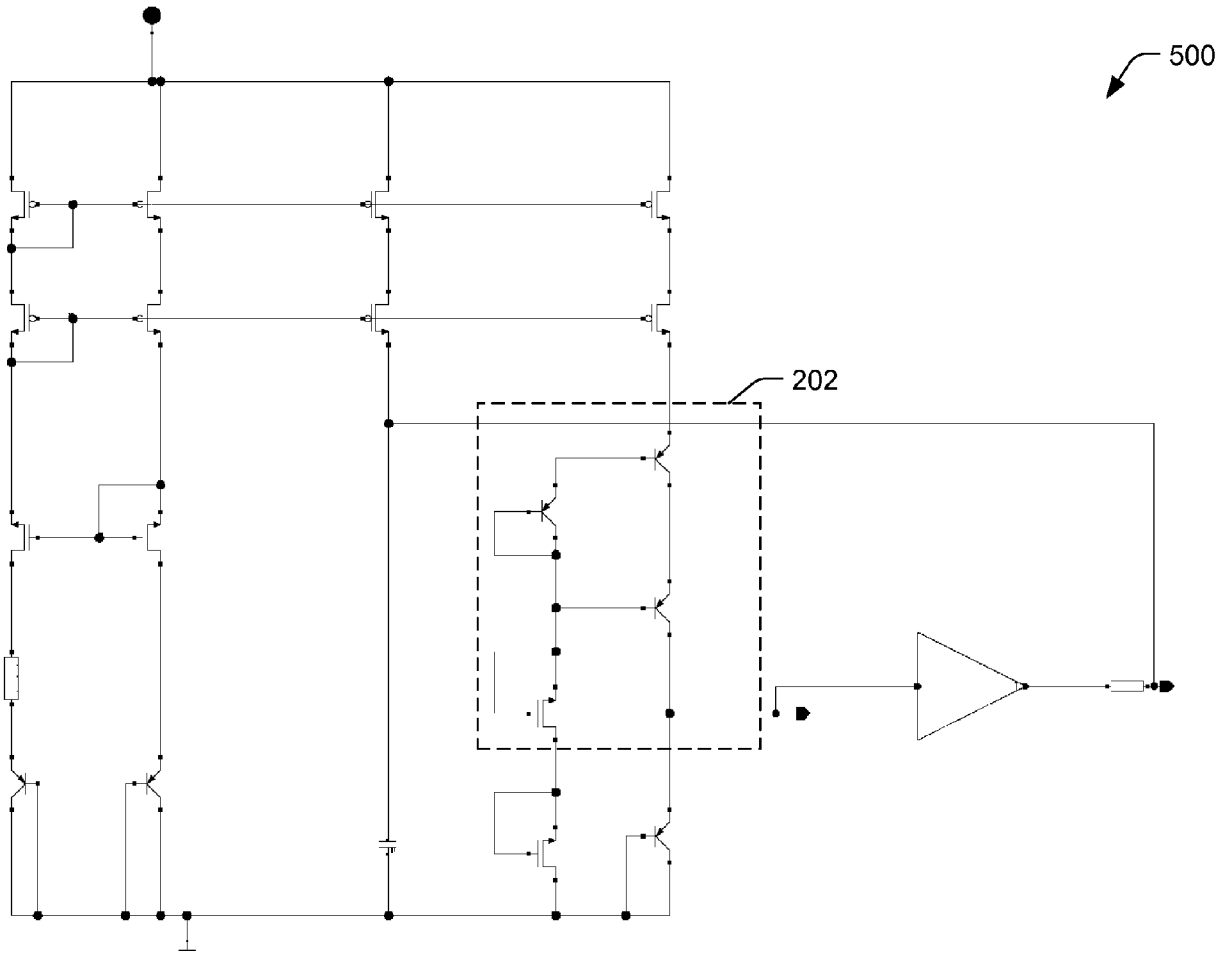
FIG. 6 is a schematic diagram of the bandgap voltage reference circuit of FIG. 5, with reduced voltage spread techniques applied, according to an implementation.

In various implementations, the devices and techniques disclosed herein (e.g., the arrangement 202 comprising series connected bipolar devices as described above) may be applied to various circuits and circuit designs to reduce the voltage spread of the bandgap voltage within the circuit. For example, as shown in FIGS. 5 and 6, a bandgap voltage reference circuit 500 is implemented with and without the arrangement 202. The table of FIG. 7 shows a comparison of example bandgap voltage spread results.

The circuit 500 of FIG. 5 illustrates the bandgap voltage reference circuit 500 without the arrangement 202 (no reduction in bandgap voltage spread) while the circuit 500 of FIG. 6 illustrates the bandgap voltage reference circuit 500 with the arrangement 202 (showing a measurable reduction in bandgap voltage spread). For the results shown in FIG. 7, the two circuits 500 are simulated in all corners with a temperature range from −40 deg C. to 150 deg C.

Referring to the legend of the table in FIG. 7, the "improved" bandgap voltage generator refers to the circuit 500 with the arrangement 202, as shown in FIG. 6. The "original" bandgap voltage generator refers to the circuit 500 without the arrangement 202, as shown in FIG. 5. The "original" voltage generator circuit (of FIG. 5) shows a spread of +/−1.1%, while the "improved" circuit 500 (of FIG. 6) shows a spread of +/−0.6% over corners and temperature, a significant improvement in variance from nominal.

Figure 8:
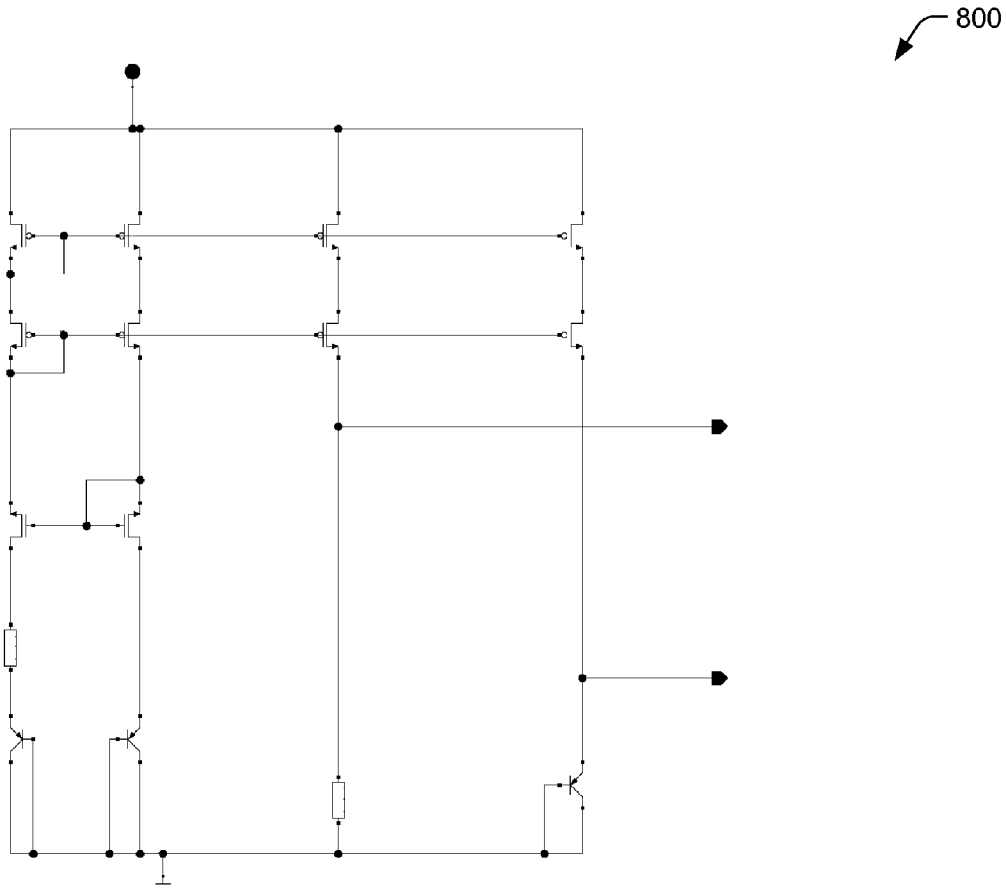
FIG. 8 is a schematic diagram of an over-temperature protection circuit, without reduced voltage spread techniques applied, according to an example.
Figure 9:
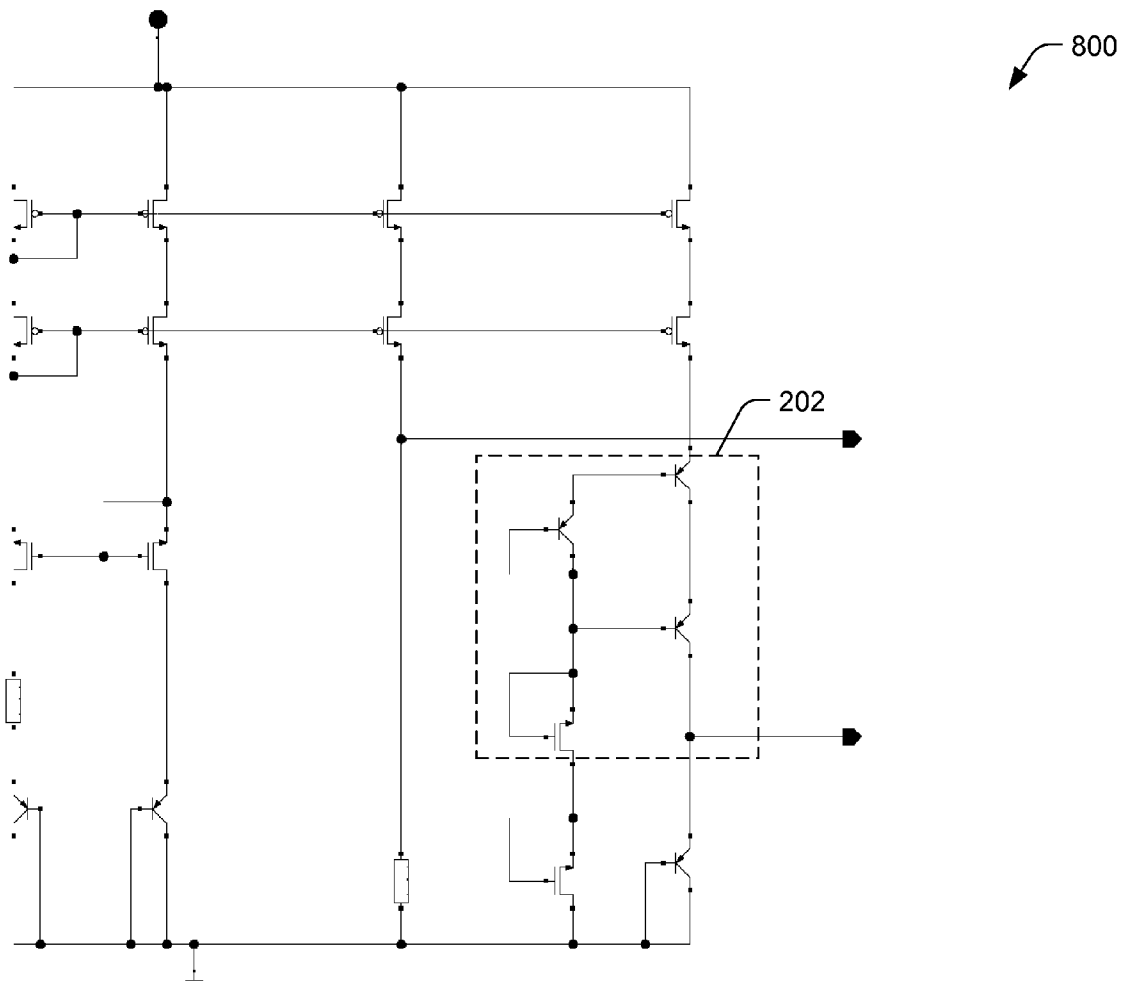
FIG. 9 is a schematic diagram of the over-temperature protection circuit of FIG. 8, with reduced voltage spread techniques applied, according to an implementation

Referring to FIGS. 8 and 9, the same technique is reproduced in an over-temperature protection circuit 800 (as part of a driver circuit). The circuit 800 of FIG. 8 illustrates the over-temperature protection circuit 800 without the arrangement 202 (no reduction in bandgap voltage spread) while the circuit 800 of FIG. 9 illustrates the over-temperature protection circuit 800 with the arrangement 202 (showing a measurable reduction in bandgap-based reference temperature—correlating to a reduction in the bandgap voltage spread). As shown in FIG. 9, the circuit 800 with the arrangement 202 is implemented in a LED driver circuit, for thermal protection of the driver circuit. For the over-temperature protection circuit 800, the negatively correlated temperature voltage is compared with the positively correlated temperature voltage to indicate an over temperature of 150 deg C.

The over temperature protection circuit 800 with the arrangement 202 (FIG. 9) shows a spread of +/−1 deg C. (+/−0.7%) while the over temperature protection circuit 800 without the arrangement 202 (FIG. 8) shows a spread of +/−3.3 deg C. (+/−2.2%). Accordingly, in various implementations, the application of the arrangement 202 provides a reduced spread of the temperature thresholds or of the reference voltage.

As mentioned, the arrangement 202 may be implemented similarly in a circuit 200, 500, 800, and the like, with sub-threshold MOS devices using $V_{GS}$ instead of $V_{BE}$ and $\Delta V_{GS}$ instead of $\Delta V_{BE}$. The techniques, components, and devices described herein with respect to the example arrangement 202 and/or the circuits 200, 500, and 800 are not limited to the illustrations of FIGS. 2-9, and may be applied to other circuits, structures, devices, and designs without departing from the scope of the disclosure. In some cases, additional or alternative components may be used to implement the techniques described herein. Further, the components may be arranged and/or combined in various combinations, while remaining within the scope of the disclosure. It is to be understood that an arrangement 202 and/or a circuit 200, 500, 800, or the like, may be implemented as a stand-alone device or as part of another system (e.g., integrated with other components, systems, etc.).

Representative Process

Figure 10:
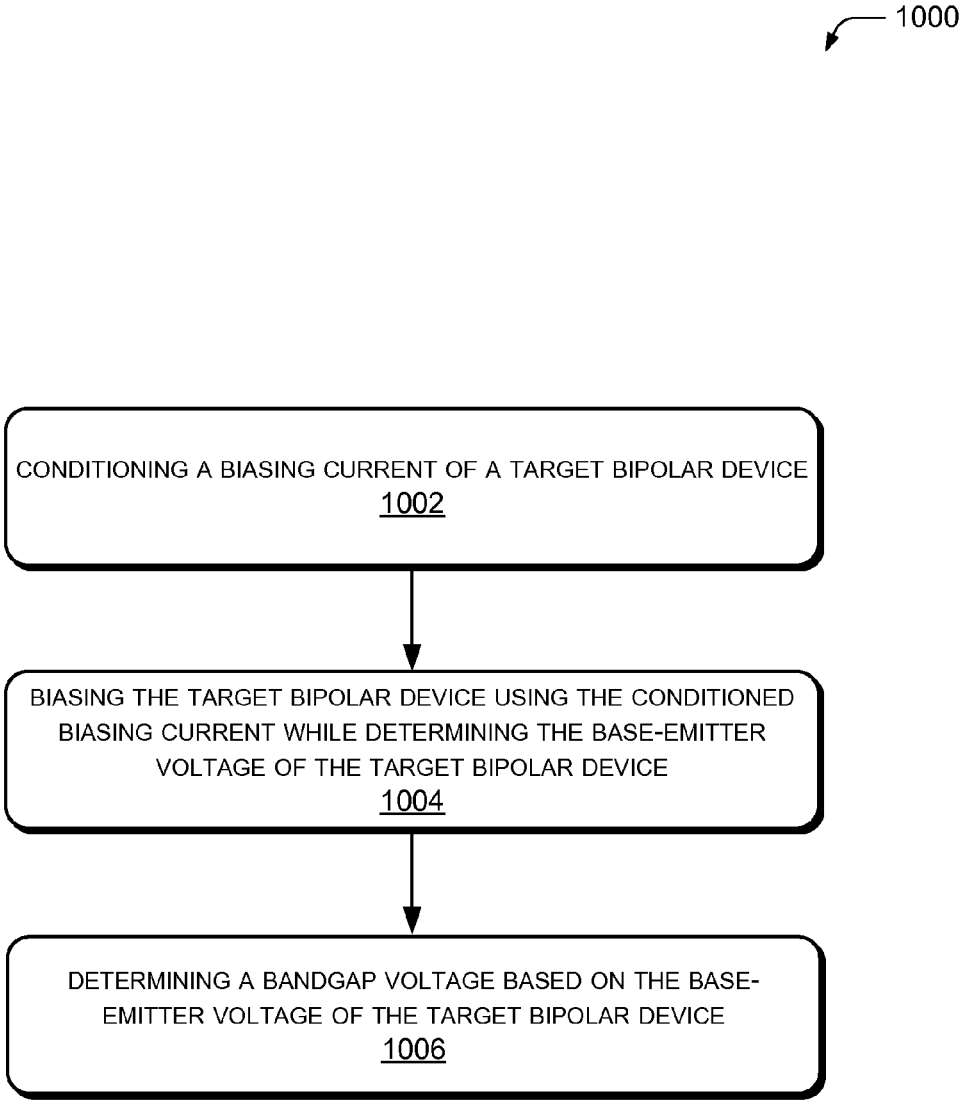
FIG. 10 is a flow diagram illustrating an example process for reducing bandgap voltage spread, according to an implementation.

FIG. 10 is a flow diagram illustrating an example process 1000 for reducing a bandgap voltage spread, according to an implementation. The process 1000 describes using a transistor or a plurality of transistors (such as T4 and T5 or arrangement 202, for example) in series to condition a bias current for a target transistor (such as T2, for example). For example, the bias current is passed through the transistor(s) prior to biasing the target transistor. When the series conditioning transistor(s) are the same or similar type of device as the target transistor, the conditioned current will be a factor of the forward current ratio. This conditioned current is then used to bias the target bipolar transistor, reducing the spread in the base-emitter voltage, and thus reducing the spread of the bandgap voltage. The process 1000 is described with reference to FIGS. 1-9.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable materials, or combinations thereof, without departing from the scope of the subject matter described herein.

At block 1002, the process includes conditioning a biasing current of a target bipolar device (such as T2, for example) to reduce a voltage spread of a base-emitter voltage of the target bipolar device. In an implementation, the conditioning includes passing the biasing current through one or more bipolar devices coupled in series to the target bipolar device prior to biasing the target bipolar device with the biasing current. For example, the process includes passing the biasing current through a greater quantity of bipolar devices to increase a reduction of the voltage spread of the base-emitter voltage of the target bipolar device, and to increase a reduction of a spread of the bandgap voltage based on the base-emitter voltage of the target bipolar device.

In an implementation, the one or more bipolar devices coupled in series to the target bipolar device comprise devices of a same or similar type as the target bipolar device.

In another implementation, the process includes increasing a forward current ratio of the target bipolar device and compensating for a saturation current of the target bipolar device by using the forward current ratio and/or the forward current gain of the target bipolar device. In an example, the biasing current is proportional to the forward current ratio.

In an implementation, the process includes increasing the saturation current of the target bipolar device, reducing a voltage spread of the base-emitter voltage of the target device, and reducing a voltage spread of the bandgap voltage based on the base-emitter voltage of the target bipolar device.

At block 1004, the process includes biasing the target bipolar device using the conditioned biasing current while determining the base-emitter voltage of the target bipolar device. For example, the process includes increasing a magnitude of the biasing current to reduce a magnitude of change to the base-emitter voltage of the target bipolar device.

At block 1006, the process includes determining a bandgap voltage based on the base-emitter voltage of the target bipolar device. For example, the bandgap voltage may be determined by summing the temperature positive correlated $\Delta V_{BE}$, which is the difference between the base-emitter voltage of one bipolar device and the base-emitter voltage of another bipolar device, with the temperature positive correlated $V_{BE}$, which is the base-emitter voltage of the other bipolar device.

In an implementation, the process includes reducing a variance of a reference temperature threshold based on the bandgap voltage. For example, reducing the voltage variance (e.g., spread) of the bandgap voltage, reduces a variance of the reference temperature based on the bandgap voltage.

In alternate implementations, other techniques may be included in the process in various combinations, and remain within the scope of the disclosure.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing example devices and techniques.

What is claimed is:

1. An apparatus, comprising:

a first bipolar device, a base-emitter voltage taken at an output node of the first bipolar device used to determine a bandgap voltage value; and a second bipolar device coupled in series to the first bipolar device at the output node, and arranged to pass a biasing current to bias the first bipolar device while the bandgap voltage value is determined, reducing a voltage spread of the bandgap voltage.

2. The apparatus of claim 1, further comprising one or more additional bipolar devices coupled in series to the first bipolar device, each of the one or more additional bipolar devices arranged to pass the biasing current while the bandgap voltage value is determined.

3. The apparatus of claim 2, wherein the first bipolar device, the second bipolar device, and the one or more additional bipolar devices comprise bipolar junction transistors (BJT).

4. The apparatus of claim 2, wherein the first bipolar device, the second bipolar device, and the one or more additional bipolar devices comprise metal-oxide-semiconductor (MOS) transistors.

5. The apparatus of claim 1, wherein the second bipolar device comprises a same or similar type bipolar device as the first bipolar device.

6. The apparatus of claim 1, wherein the voltage spread of the bandgap voltage is reduced based on the forward current ratio of at least one of the first and the second bipolar device.

7. The apparatus of claim 1, wherein the voltage spread of the bandgap voltage is reduced by reducing a voltage spread of the base-emitter voltage of the first bipolar device.

8. The apparatus of claim 1, wherein the second bipolar device is directly coupled in series to the first bipolar device at the output node.

9. An electrical circuit, comprising:

a bandgap voltage based reference circuit portion arranged to provide a reference voltage based on a base-emitter voltage taken at an output node of a target bipolar device; and a bandgap voltage variance reduction circuit portion, including:

the target bipolar device; and one or more other bipolar devices coupled in series to the target bipolar device at the output node, and arranged to pass a biasing current through the one or more other bipolar devices to the output node to bias the target bipolar device while the reference voltage value is determined, the one or more other bipolar devices arranged to reduce a voltage spread of the base-emitter voltage of the target device by passing the biasing current.

10. The electrical circuit of claim 9, wherein the bandgap voltage variance reduction circuit portion is arranged to reduce a voltage spread of a bandgap voltage produced by the bandgap voltage based reference circuit portion by reducing the voltage spread of the base-emitter voltage of the target device.

11. The electrical circuit of claim 9, wherein the bandgap voltage variance reduction circuit portion is arranged to reduce the voltage spread of the base-emitter voltage of the target device by passing the biasing current through the one or more other bipolar devices.

12. The electrical circuit of claim 11, wherein the one or more other bipolar devices comprise devices similar to or a same type as the target bipolar device.

13. The electrical circuit of claim 11, wherein a greater quantity of the one or more other bipolar devices results in a more reduced bandgap voltage spread.

14. The electrical circuit of claim 11, wherein the bandgap voltage variance reduction circuit portion is arranged to compensate for changes in a saturation current of the target bipolar device, to reduce the voltage spread of the base-emitter voltage of the target device, and to reduce a voltage spread of a bandgap voltage produced by the bandgap voltage based reference circuit portion.

15. The electrical circuit of claim 9, wherein the electrical circuit comprises a portion of an integrated circuit (IC) arranged to provide a reference voltage to one or more other portions of the IC.

16. The electrical circuit of claim 9, wherein the electrical circuit comprises an over temperature protection circuit.

17. A method, comprising:

conditioning a biasing current of a target bipolar device to reduce a voltage spread of a base-emitter voltage of the target bipolar device by passing the biasing current through one or more bipolar devices series-connected to the target bipolar device at an output node of the target bipolar device;

biasing the target bipolar device using the conditioned biasing current while determining the base-emitter voltage taken at the output node of the target bipolar device with reference to a common node; and determining a bandgap voltage based on the base-emitter voltage taken at the output node of the target bipolar device with reference to the common node.

18. The method of claim 17, further comprising:

increasing a forward current ratio of the target bipolar device;

increasing a saturation current of the target bipolar device;

reducing a voltage spread of the base-emitter voltage of the target device; and reducing a voltage spread of the bandgap voltage based on the base-emitter voltage of the target bipolar device.

19. The method of claim 17, wherein the one or more bipolar devices coupled in series to the target bipolar device comprise devices of a same or similar type as the target bipolar device.

20. The method of claim 17, further comprising passing the biasing current through a greater quantity of bipolar devices to increase a reduction of the voltage spread of the base-emitter voltage of the target bipolar device, and to increase a reduction of a spread of the bandgap voltage based on the base-emitter voltage of the target bipolar device.

21. The method of claim 17, further comprising compensating for a saturation current of the target bipolar device by using at least one of the forward current ratio and the forward current gain of the target bipolar device.

22. The method of claim 21, wherein the biasing current is proportional to the forward current ratio.

23. The method of claim 17, further comprising increasing a magnitude of the biasing current to reduce a magnitude of change to the base-emitter voltage of the target bipolar device.

24. The method of claim 17, further comprising reducing a variance of a reference temperature threshold based on the bandgap voltage.

* * * * *